United States Patent [19]

Gano

[11] Patent Number: 4,796,698

[45] Date of Patent: Jan. 10, 1989

[54] LANDING NIPPLE AND PLUG

[75] Inventor: John C. Gano, Carrollton, Tex.

[73] Assignee: Otis Engineering Corporation, Dallas, Tex.

[21] Appl. No.: 46,634

[22] Filed: May 7, 1987

Related U.S. Application Data

[62] Division of Ser. No. 867,499, May 28, 1986, Pat. No. 4,691,781.

[51] Int. Cl.[4] ..... E21B 33/128

[52] U.S. Cl. ..... 166/135; 166/139; 166/140; 166/217; 166/117.5

[58] Field of Search ..... 166/132, 117.5, 135, 166/138, 139, 140, 192, 195, 196, 217, 368, 88, 95

[56] References Cited

U.S. PATENT DOCUMENTS

| | | | |
|---|---|---|---|
| 3,250,331 | 5/1966 | Boyle | 166/135 |
| 3,414,056 | 12/1968 | Brown et al. | 166/135 |
| 3,593,784 | 7/1971 | Brown et al. | 166/217 |
| 3,789,925 | 2/1974 | Brown | 166/217 |
| 3,797,864 | 3/1974 | Hynes et al. | 166/88 X |
| 4,058,162 | 11/1977 | Smith | 166/139 |
| 4,121,660 | 10/1978 | Koleilat | 166/135 |
| 4,479,539 | 10/1984 | Tamplen et al. | 166/217 |
| 4,651,818 | 3/1987 | Johnson et al. | 166/140 |

*Primary Examiner*—Bruce M. Kisliuk
*Attorney, Agent, or Firm*—M. H. Gay

[57] ABSTRACT

A drilling template for multiple wells has a dummy post on the template associated with each wellhead position and a wellhead connector is transferable between the dummy post and wellhead during completion and workover operations. A subsea wellhead is provided with a guide frame on which a dummy post is supported permitting the wellhead connector to be transferred between the dummy post and the wellhead. The wellhead includes a landing nipple and tubing hanger which permit the tubing hanger to tilt relative to the casing head without breaking the seal between the hanger and nipple. The wellhead connector is latched and released from the tubing hanger by reciprocation of a control sleeve and the connector is held in the unlatched position by a releasable lock. The wellhead connector includes a plug having a metal seal held in compression together with a resilient seal.

5 Claims, 9 Drawing Sheets

LANDING NIPPLE AND PLUG

This application is a division of my copending patent application Ser. No. 06/867,499, filed May 2, 1986 now Pat. No. 4,691,781.

This invention relates to well drilling and completion equipment.

Drilling templates are old and well known but none have in the past been equipped with wellhead connectors carried by the template which can be moved between the template and the wellhead during completion or workover operations. Further, there has not been known a casing head provided with means for supporting a wellhead connector which is movable between the support means and tubing head.

Wellhead connectors are known, but are connected between flow lines and the casing head and are very large and heavy. As the connectors are secured to the casing head, the tubing hangers of these types of wellheads are protected from outside forces such as those imposed by fishing nets snagging a wellhead.

Known wellhead connectors are complex in their latch and release mechanisms. They are not generally capable of being handled by remote operated vehicles and do not include a simple latch and release mechanism provided by a reciprocal sleeve together with provisions for locking the connector in release position by a system which is released by reciprocation of the control sleeve thus preventing accidental movement of the connector system to latch position during handling.

Wellhead plugs are known. These known plugs do not provide for a metallic seal held under substantial compression.

An object of this invention is to provide a subsea wellhead in which a locked down tubing hanger may tilt relative to its landing nipple while maintaining a seal therewith.

Another object is to provide a wellhead connector which is latched and released by reciprocation of a control sleeve in which the connector is held in the unlatched position by a releasable lock which is also controlled by the control sleeve.

Another object is to provide a subsea drilling template for drilling a plurality of wells in which wellhead connectors are carried by the template on dummy posts and are movable between the dummy posts and associated wellheads.

Another object is to provide a subsea wellhead having a guide frame and a dummy post on the guide frame and a wellhead connector movable between the wellhead and the dummy post.

Another object is to support a wellhead connector on a tubing hanger, thus reducing the size and weight of the connector which permits handling of the connector by a remote operated vehicle.

Another object is to provide a wellhead plug and landing nipple having a metallic seal held under substantial compression to provide a good seal.

Other objects, features and advantages of the invention will be apparent from the drawings, the specification, and the claims.

In the drawings wherein illustrative embodiments of this invention is shown, and wherein like reference numerals indicate like parts:

Figure 3:
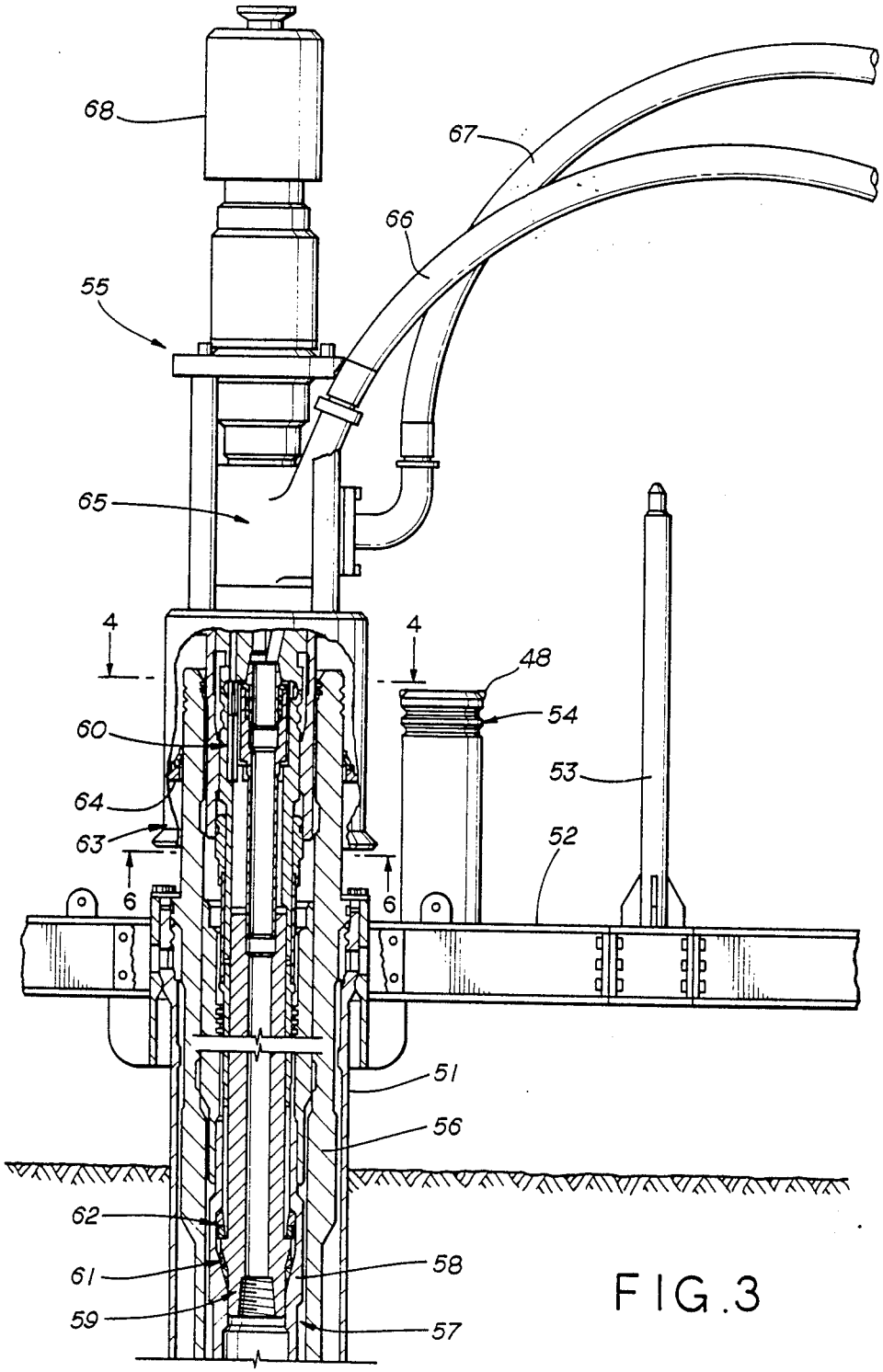
FIG. 3 is a view, partly in elevation and partly in section, of a wellhead constructed in accordance with this invention.
Figure 4:
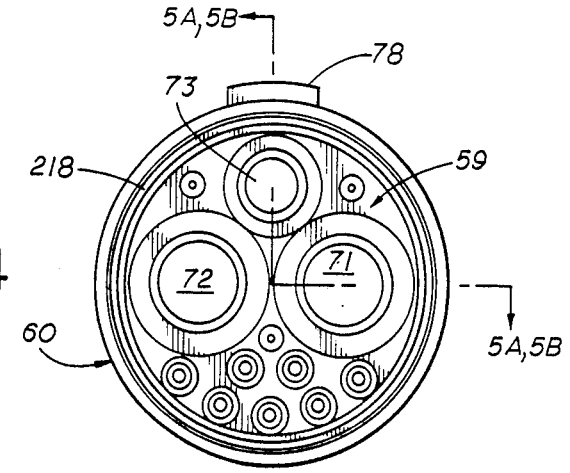
FIG. 4 is a top plan view of a tubing hanger taken along line 4—4 of FIG. 3 with the wellhead connector omitted.
Figure 6:
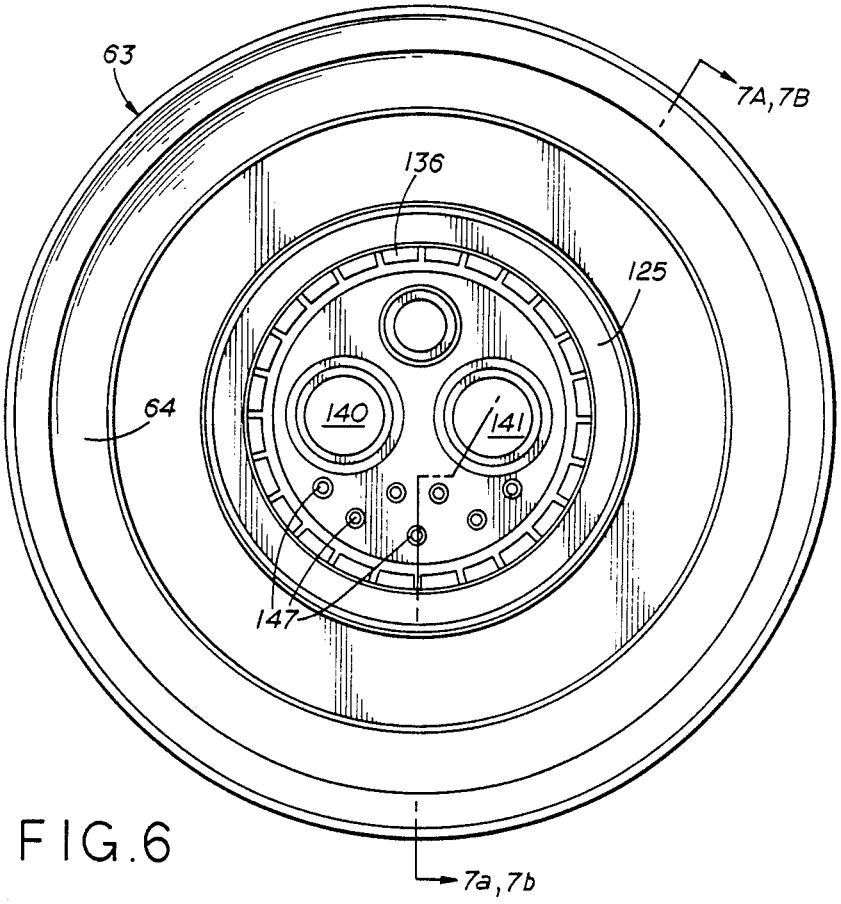
Figure 5A:
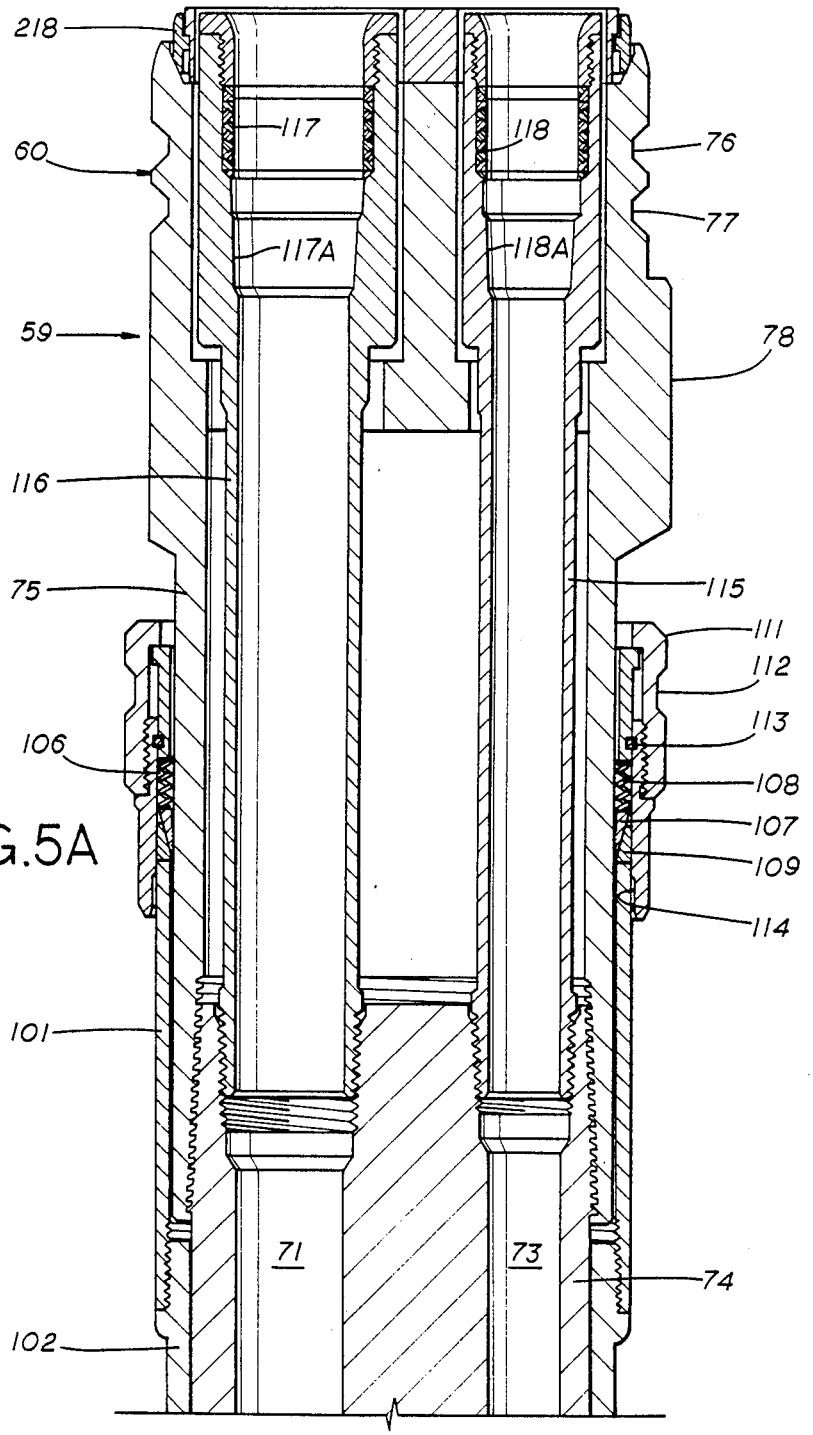
Figure 5B:
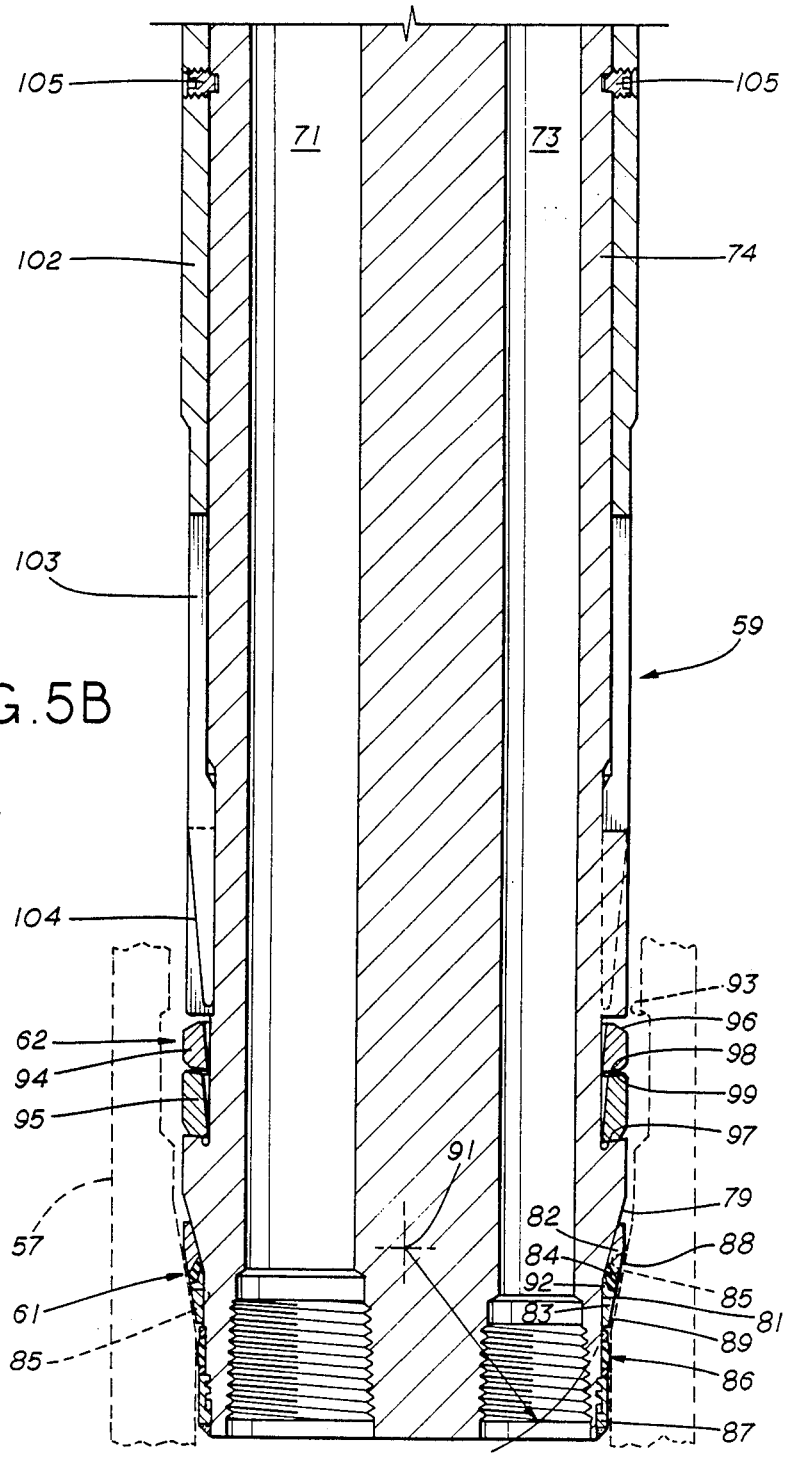
Figure 7A:
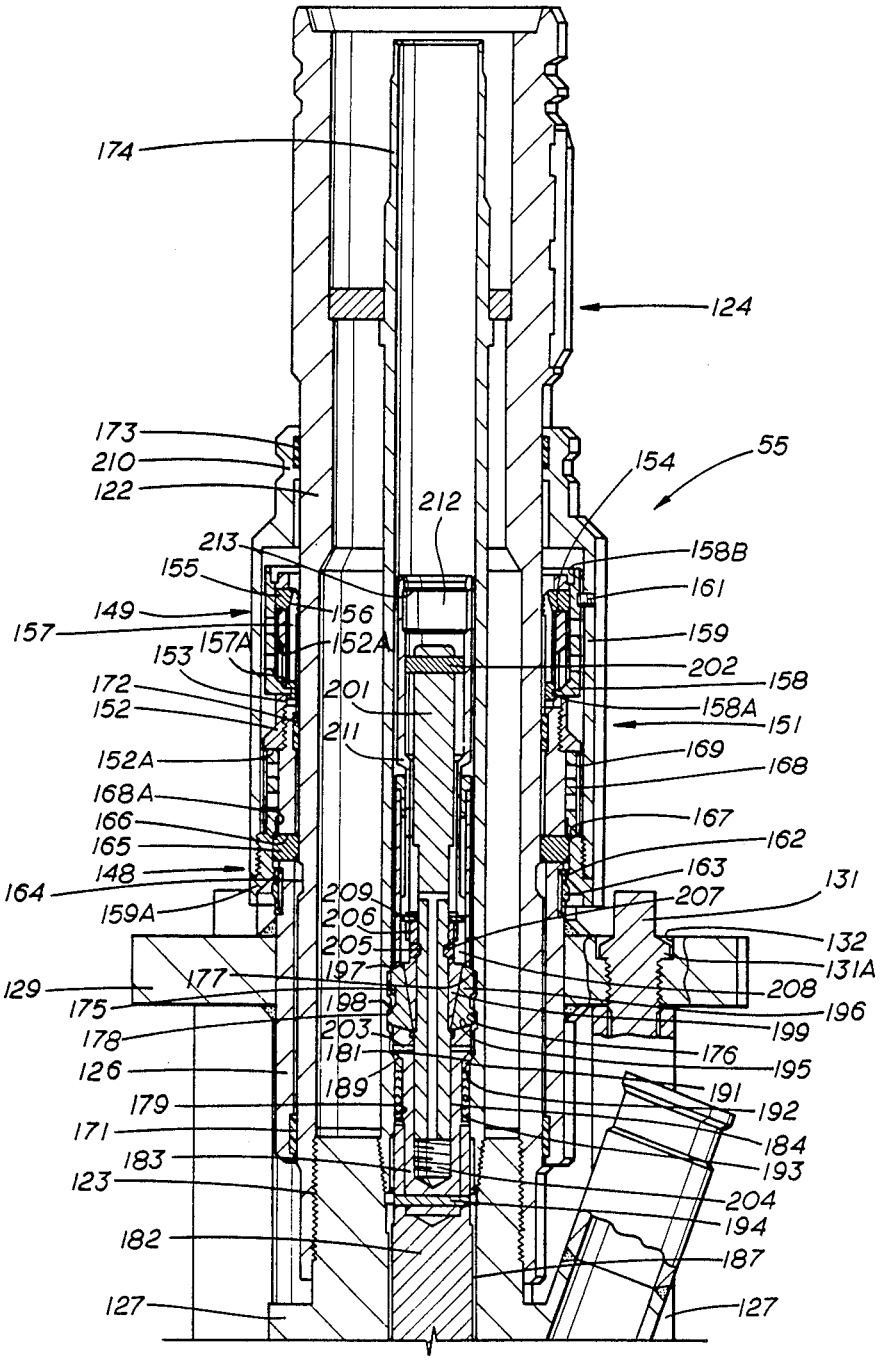
Figure 7B:
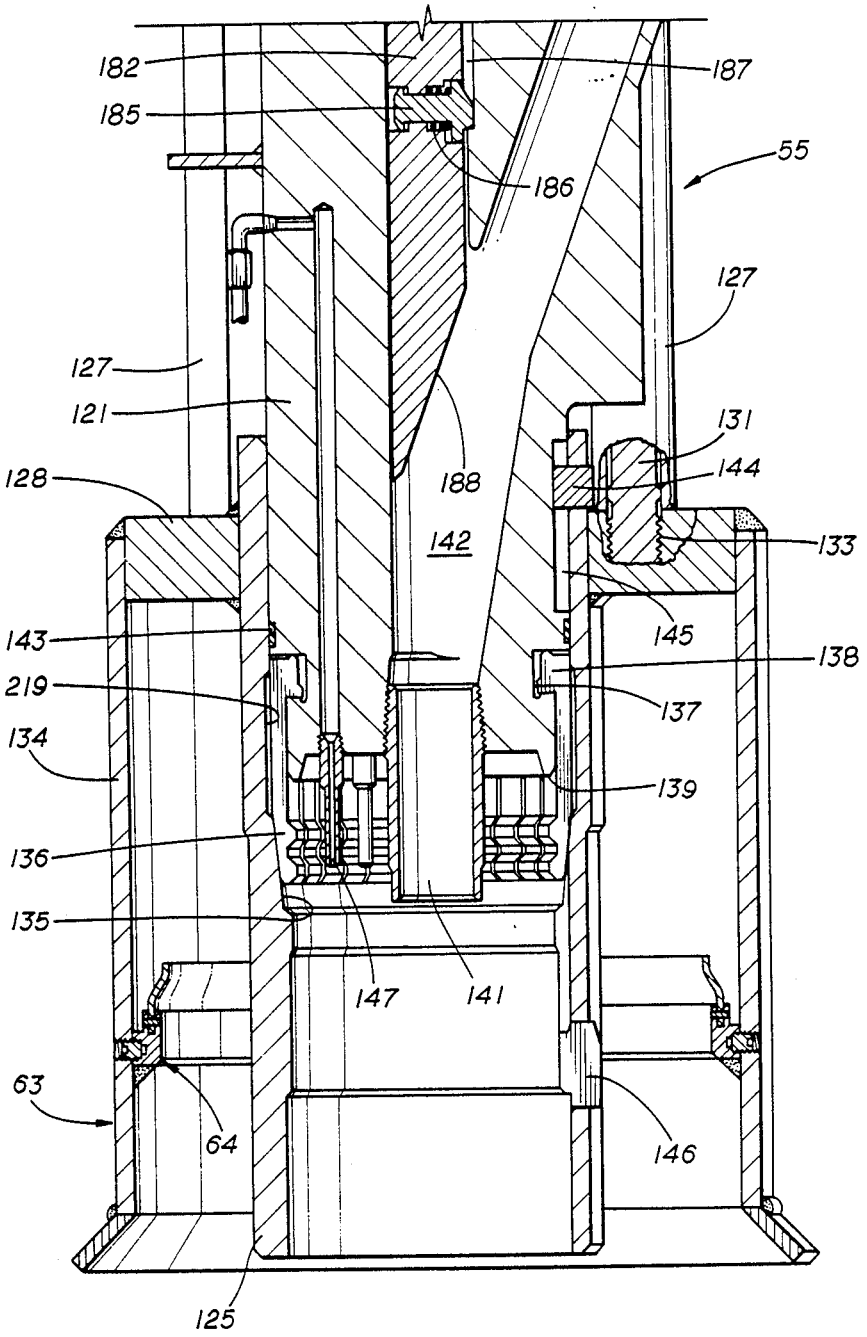
Figure 8:
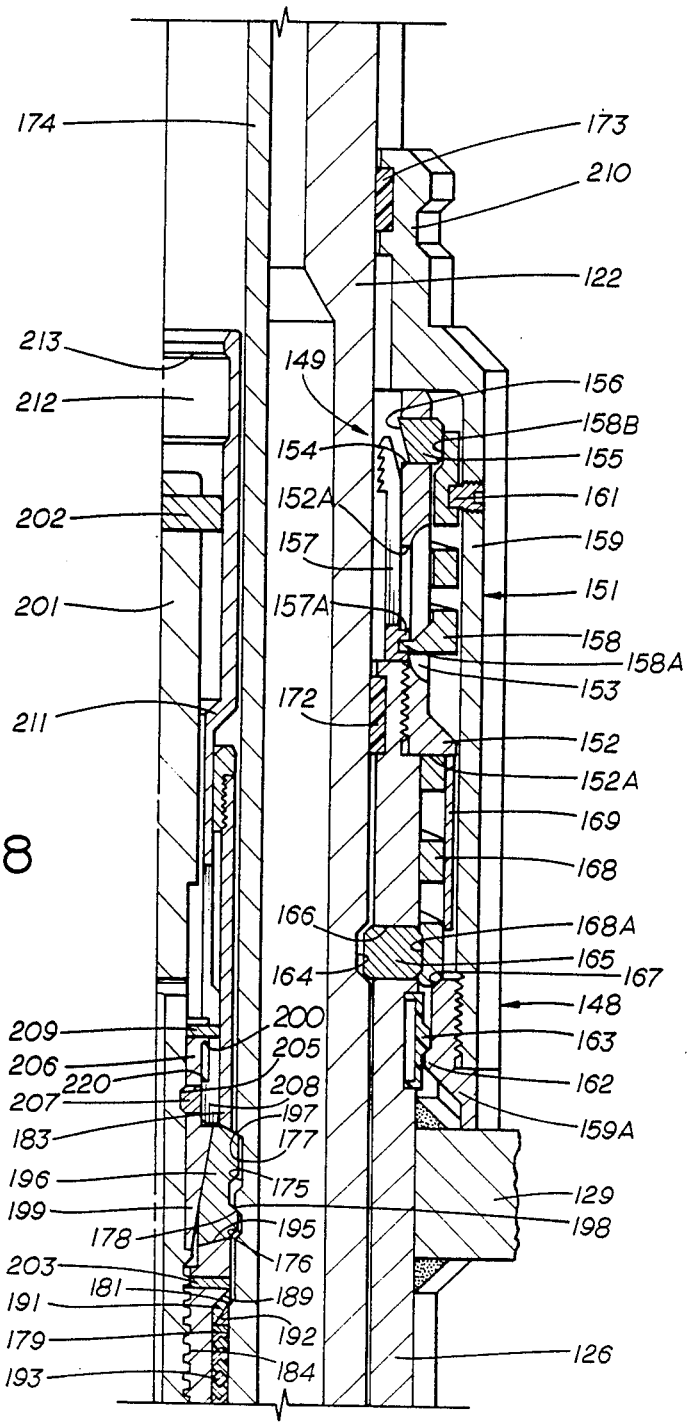

FIG. 5A and its continuation view FIG. 5B are sectional views taken along lines 5A—5A and 5B—5B of FIG. 4 with a fragment of the landing nipple shown in dashed lines;

FIG. 6 is a worm's eye view along line 6—6 of FIG. 3 of the wellhead connector with the wellhead omitted;

FIG. 7A and its continuation view FIG. 7 are sectional views taken along lines 7A—7A and 7B—7B of FIG. 6; and FIG. 8 is a sectional view of a fragment of FIG. 7A illustrating the wellhead connector in its released position.

Figure 9A:
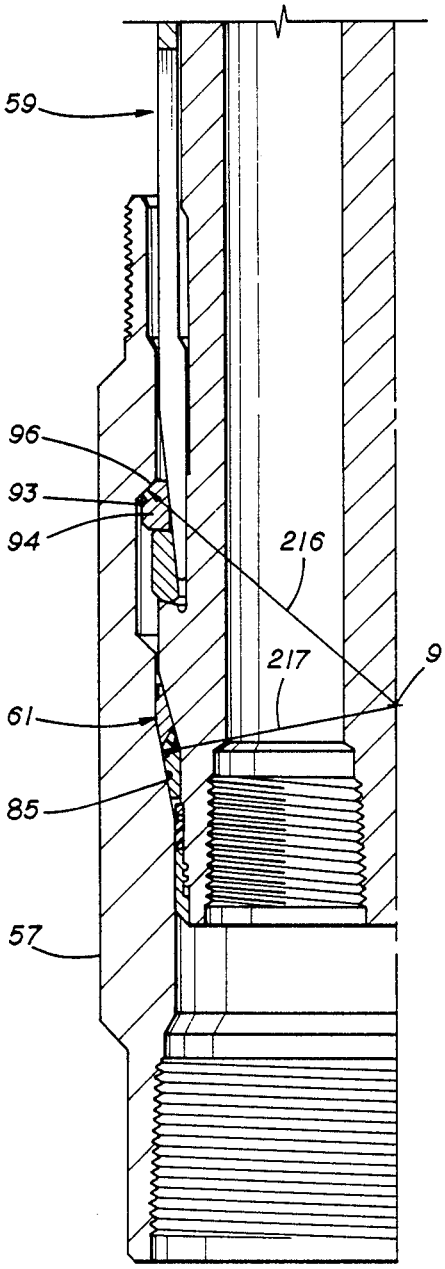

FIG. 9A is a modified fragment of the apparatus shown in FIG. 5B with the hold-down rings in expanded position.

Figure 9B:
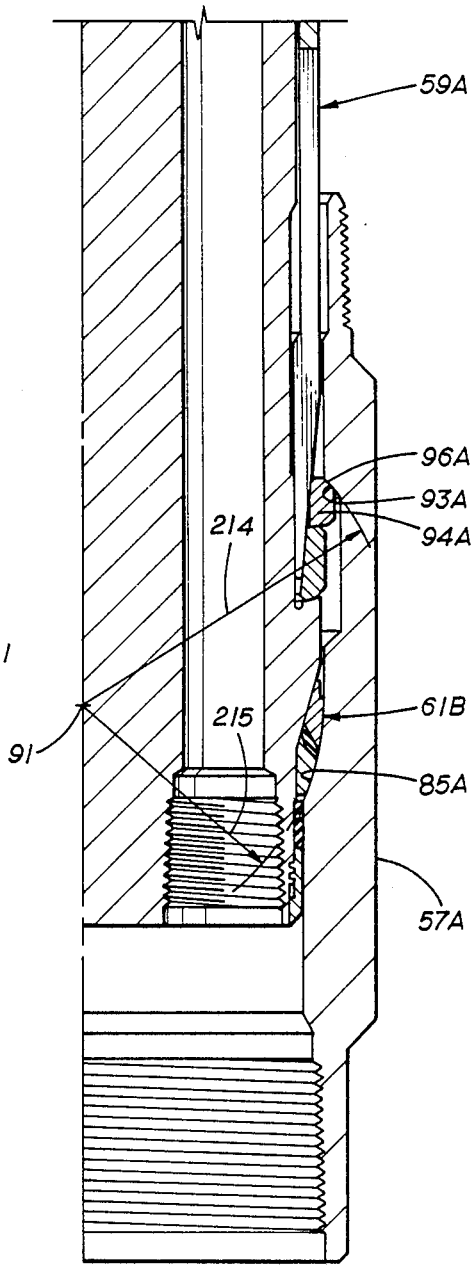

FIG. 9B is a fragment of the apparatus shown in FIG. 5B with the hold-down rings in expanded position.

Figure 1:
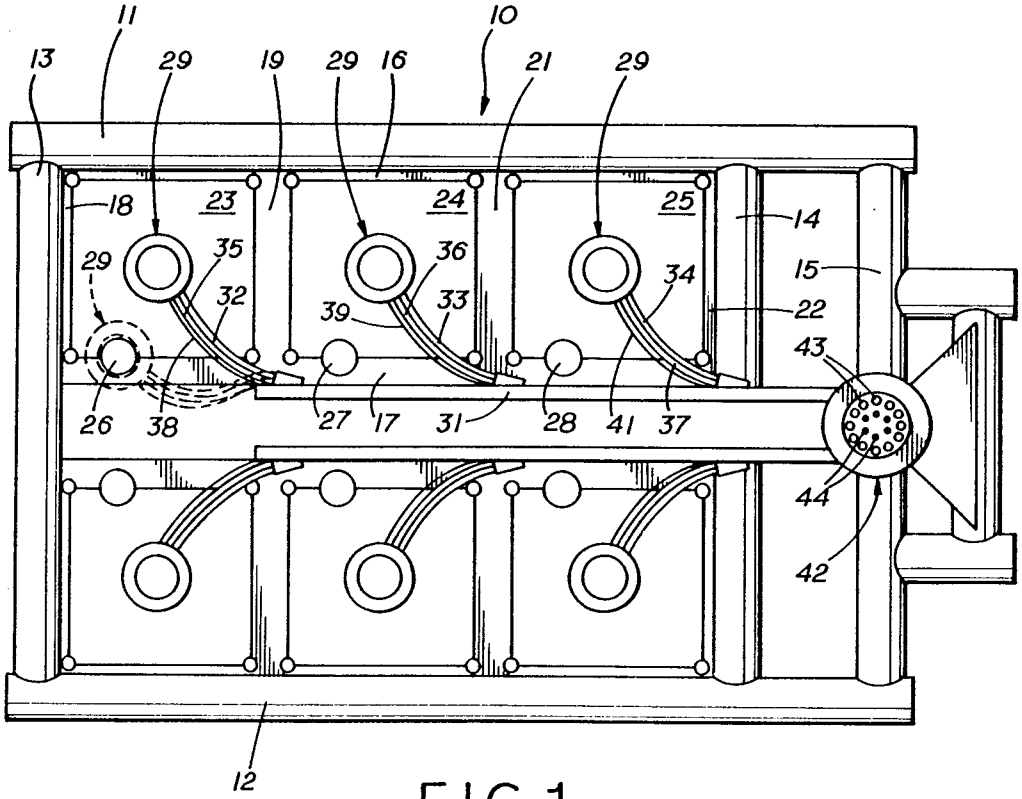
FIG. 1 is a diagrammatical plan view of a drilling template constructed in accordance with this invention.

Referring first to FIG. 1, a drilling template is indicated generally at 10. The template includes a grid of structural members which in the illustrated embodiment comprises spaced pipes 11 and 12 secured to each other by connecting pipes 13, 14, and 15. While the grid is shown to be rectangular in form, it will be appreciated that the shape of the grid is not critical and may take any desired form. While the grid may be made up of large pipes welded together as illustrated, any other type of structural members may be utilized. The grid illustrated is composed of two identical sections each providing for the drilling of three wells through the template. As these two sections are identical, only one will be described here.

A structural member such as an I-beam or angle iron 16 is secured to the pipe 11 and extends between pipes 13 and 14. Another structural member such as an I-beam or angle iron 17 is spaced from the member 16 and extends between the pipes 13 and 14. Additional structural members 18, 19, 21, and 22 extend between pipes 11 and structural member 17 to define therewith open spaces 23, 24, and 25 in the grid through which wells may be drilled.

The structural member 17 supports dummy posts 26, 27, and 28.

These dummy posts are adapted to support the wellhead connectors indicated generally at 29. These wellhead connectors (which will be disclosed in detail hereinafter) are shown in solid lines on the wellheads after the wells have been completed. One wellhead connector is shown in dashed lines on dummy post 26 illustrating that the wellhead connector is movable between the dummy posts and the wellhead for completion of the well and for workover operations.

The template includes a plurality of production pipes, one of which is shown at 31. The production pipe 31 receives production fluid from the flexible hose 32 connecting the production pipe with the wellhead connector 29 associated with dummy post 26. Other production pipes not shown are connected to flexible hoses 33 and 34 extending to other wellhead connectors 29. In like manner, annulus hose connections 35, 36, and 37 extend from the wellhead connectors 29 to a pipe located adjacent the production pipe 31, but not shown. In further like manner, control lines indicated at 38, 39, and 41 are also of a flexible nature and extend from the wellhead connectors to control lines secured to the grid and not shown.

The grid supports a marine riser indicated generally at 42. Within the riser a plurality of flow lines 43 connect the template to the surface and provide for fluid flow between the surface and the several wells. Also within the riser are the control conduits 44 which connect to the control lines such as 38, 39, and 41 for controlling equipment such as subsurface safety valves which will be positioned in the tubing below the mud line.

Figure 2:
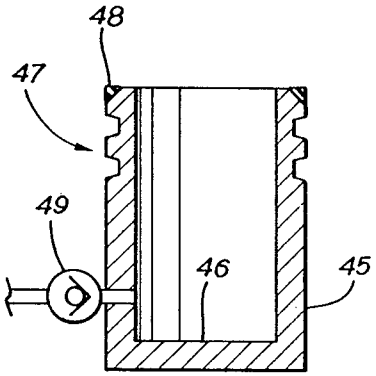
FIG. 2 is a schematic illustration of a dummy post for supporting a wellhead connector.

One of the dummy posts is shown in FIG. 2. The post is a tubular member 45 having a closure 46 at its lower end with the upper end of the tubular member 45 being open. On the upper outer periphery of the post there is provided a grooved configuration 47 adapted to cooperate with latch lugs in the wellhead connectors to permit latching of the wellhead connectors to the post. The upper outer periphery of the post is provided with a seal 48 to seal between the post and a downwardly facing surface in the wellhead connector.

A check valve indicated generally at 49 provides for flow from the interior of the post to the exterior of the post while preventing backflow. With a wellhead connector positioned on the post and sealingly secured thereto, protective fluids may be pumped through the flexible hoses into the wellhead connectors and the interior of the dummy post to fill the interior of the connector and the interior of the dummy post and protect the wellhead connector from the elements. Preferably the check valves 49 are back pressure valves capable of holding the protecting fluids within the wellhead connector and the post but permitting fluids to be pumped into the system and, if desired, exhausted through the back pressure valve.

A wellhead constructed in accordance with this invention is shown in FIG. 3. The wellhead includes an outer casing 51. A guide frame 52 is carried by the outer casing 51 and includes a plurality of guide posts, one of which is shown at 53. The guide frame 52 also supports the dummy post 54 for supporting the wellhead connector indicated generally at 55 during drilling or completion of the well or during workover as desired.

An intermediate casing 56 is supported within the outer casing 51 and in turn supports the inner casing indicated generally at 57. This inner casing 57 includes the special no-go nipple 58 for supporting the tubing hanger indicated generally at 59. As will be explained hereinafter in more detail, the seal means indicated generally at 61 and the hold-down means indicated generally at 62, permit the tubing hanger 59 to tilt within the casing 57 without breaking the seal 61. This prevents a loss of sealing function in the event the tubing head is tilted by a fishing net or the like engaging the wellhead connector 55 and exerting a horizontal force on the wellhead connector.

The tubing hanger includes a nipple indicated generally at 60 having grooves at its upper end for receiving the latch lugs of the wellhead connector as will more fully appear hereinafter.

The wellhead connector 55 includes an outer depending bell-shaped member indicated generally at 63 which telescopes over the intermediate casing 56 and wiper means indicated generally at 64 carried by the bell-shaped member 63. The wiper means engages the intermediate casing 56 and prevents marine life and other undesirable matter from moving upwardly into the wellhead connector.

The wellhead connector may include the diverter housing indicated generally at 65 providing for vertical access into the well and diverted flow from the well through the flexible hose 66 to a flow line sled and flow lines (not shown). A similar second flow line is located immediately behind the flow line 66. The flexible hose 67 is the annulus line and provides for access to the well annulus as will more fully appear hereinafter. The wellhead is closed at its upper end by the vertical access cap 68.

The tubing hanger indicated generally at 59 is shown in detail in FIGS. 4, 5A, 5B and 9B. As best shown in FIG. 4, the hanger is provided with flow ways 71 and 72 which are adapted to receive fluid from tubing depending from these flow ways. The flow way 73 provides access to the annulus.

The tubing hanger body includes the lower body sub 74 and the upper body sub 75. The upper body sub 75 has at its upper end a pair of adjacent grooves 76 and 77 for latching of the wellhead connector to the tubing head as shown in FIG. 3. Projecting from the upper sub 75 is an orientation lug 78.

The lower end of the lower sub 74 is provided with a downwardly facing bevelled shoulder 79 which joins a lower surface 81 of constant diameter. These two surfaces cooperate with the seal indicated generally at 61 to seal between the seal 61 and the tubing hanger 59. The seal 61 provides a metallic seal between the landing nipple 57 and the tubing hanger 59. Preferably the metallic seal is provided by an upper metallic seal member 82 and a lower metallic seal member 83. It is further preferred that a resilient seal 84 be positioned between the two metallic seals 82 and 83. These three seals engage the upwardly facing no-go shoulder shown in dashed lines at 85 of the segment of landing nipple 57 shown in dashed lines in FIG. 5B.

The three seals 82, 83, and 84 are retained on the landing nipple by the lowermost seal indicated generally at 86 and the nut 87 on the lower end of the tubing hanger 57. This lower seal 86 provides a resilient seal with the bore of the landing nipple 57 at 88.

In accordance with this invention, the outer peripheral surface 88 on upper seal 82 and 89 on lower seal 83 form a frusto-conical surface. The no-go shoulder 85 on the nipple 57 forms a complimentary frusto-conical surface. The frusto-conical surfaces 85 and 88–89 extend tangent to a circle having its center at 91. As these surfaces are substantially segments of a sphere, they permit the tubing hanger to rotate or tilt about the point 91 if a horizontal force is applied to the upper end of the tubing hanger. Slight movement or distortion of the two metal seal rings may occur during this tilting movement.

The lower seal 83 is provided with an inner upwardly extending thin section 92 which is expanded by the downwardly facing shoulder 79 as the tubing hanger is supported in the landing nipple to place the resilient seal 84 in compression.

The hold-down means 62 includes the downwardly facing no-go shoulder shown in dashed lines at 93, the pair of expandable split rings 94 and 95 as well as means for expanding these rings. Two rings are preferred over one to provide large shoulder contact between the rings and the landing nipple as well as the tubing hanger.

The downwardly facing shoulder 93 in the landing nipple as well as the upwardly facing shoulder 96 on the upper ring are formed on lines tangent to a circle about the center 91. As these surfaces are again substantially segments of a sphere, they will move relative to each other and permit rotation or tilting of the tubing hanger about the center 91 when a horizontal force is applied to the tubing hanger as by the wellhead connector being snagged by a fishing net or the like. There will be a clearance between the casing head and tubing hanger above the hold-down rings and the tubing hanger will be able to tilt within this clearance until it engages the casing hanger without breaking the seal provided by the metal seal rings.

The tubing hanger has an upwardly and outwardly bevelled face 97 on which the lower ring 95 rests. The lower end of the lower ring 95 is bevelled complimentary to the surface 97. Also, the upper surface 98 of the lower ring and the lower surface 99 of the upper ring are complimentary and are bevelled slightly in an upward and outward direction. Thus, after the tubing hanger has been seated on the no-go shoulder 85, expansion of the rings 94 and 95 will affect relative upward movement of these rings to bring the upper ring 94 into firm engagement with the downwardly facing no-go shoulder 93 to hold the tubing hanger firmly on the no-go shoulder 85.

The expander includes the upper expander sleeve 101 and the lower expander sleeve 102. At its lower end the lower expander sleeve 102 is provided with a plurality of split expander fingers 103 which have upwardly and outwardly inclined surfaces 104 to provide a downwardly facing expander cone which when the sleeve 102 moves downwardly will project under the two rings 94 and 95 and expand them outwardly until the upper ring 94 firmly engages the downwardly facing no-go shoulder 93.

To prevent premature actuation of the expander sleeve, it is secured to the tubing head housing section 74 by one or more shear pins 105.

At the upper end of the upper sleeve 101, windows 106 are provided in the sleeve and within these windows are positioned slips 107 urged downwardly by springs 108 into engagement with cone segments 109. The slips 107 are provided with slip teeth which engage the upper tubing hanger section 75 and prevent upward movement of the expander sleeve 101–102. Thus, a setting tool engaging the setting sleeve 111 may move the setting sleeve and with it the expander cone 104 downwardly to expand the two rings 94 and 95. The slips 107 hold the expanders in their down position. When it is desired to release the tubing hanger hold-down rings, a tool engages the groove 112 in the setting sleeve 111 and an upward pull shears the shear ring 113 and the sleeve 111 moves upwardly until the inner enlarged diameter section 114 overlies the cone 109 and permits the cone, which is split segments, to expand outwardly and release the slips 107.

The tubing hanger includes the two upper pup joints 115 and 116 which have at their upper end resilient seals indicated generally at 117 and 118 and metal seal surfaces 117A and 118A for engagement by depending tubes carried by the wellhead connector 55.

The wellhead connector 55 is shown in more detail in FIG. 6, FIGS. 7A and 7B, and FIG. 8.

The wellhead connector includes elongate mandrel means provided by the lower mandrel 121 and upper mandrel 122 secured together by the threaded connection 123. At the upper end of the upper mandrel are a pair of external grooves and orientation key indicated generally at 124 for suspending and manipulating the wellhead connector and for attaching the vertical access cap 68 (see FIG. 3).

A latch sleeve is provided by the lower latch sleeve 125 and the upper latch sleeve 126. These sleeves are held in spaced relationship by a plurality of spacer sleeves 127 extending between a flange 128 on the lower sleeve 125 and a flange 129 on the upper sleeve 126. Bolts 131 having a cap 131A engage the counterbore 132 in flange 129 and are threaded to the lower flange 128 by the threaded engagement 133. If desired, other means might be utilized to secure the upper and lower sleeves to each other.

The lower flange 128 carries a bell housing 134 which surrounds the lower sleeve 125 and fits over the casing 56 as shown in FIG. 3. The wiper 64 protects the wellhead from marine life as indicated hereinabove.

One of the mandrel and sleeve carries a latch bowl means and the other carries latch lugs which are movable radially by the bowl means to latch the connector to a tubular member with telescoping movement of the latch sleeve. Preferably the latch bowl 135 is carried by the sleeve 125 and a plurality of latch lugs 136 are cooperable with the upwardly and outwardly inclined bowl 135 to force the latch lugs 136 inwardly in a radial direction to latch the wellhead connector to the tubing hanger as shown in FIG. 3. The latch lugs 136 may take any form such as the fingers illustrated which are held in the groove 137 by the enlargement 138 on the upper end of each of the lugs 136. The wellhead connector is run with the latch sleeve 125 in a lower position which permits the latch lugs 136 to expand. The wellhead connector is set down on the tubing head until the downwardly facing surface 139 on lower mandrel 121 rests upon the tubing head as shown in FIG. 3. Thereafter upward movement of the latch sleeve 125 cams the latch lugs 136 inwardly to lock the connector to the tubing head. The pup joint 141 extends into and sealingly engages the packing in the upper end of the tubing head such as packing 117 or 118 and surfaces 117A or 118A. The pup joint 141 directs flow to the flowway 142 in the wellhead connector.

A centralizing plastic bearing 143 is provided between the latch sleeve 125 and the lower mandrel 121.

A lug 144 carried by the lower sleeve 125 cooperates with a male slot 145 in the lower mandrel to maintain proper orientation between these parts. A ramp 146 carried by the lower sleeve 125 cooperates with the lug 78 on the tubing hanger to orient the wellhead connector with the tubing hanger where dual flow lines such as the flow line 140 and 141 are employed (see FIG. 6).

Control fluid may be delivered through the wellhead connector by way of the depending pup joint 147 which sealingly engages a flow line in the tubing hanger as shown in FIG. 3.

A releasable locking means indicated generally at 148 cooperates with a slip bowl and slips indicated generally at 149 to govern the relative reciprocal motion between the upper mandrel 122 and the upper latch sleeve 126 which in turn control the position of the lower latch bowl 135 and the latch lugs 136. The releasable locking means 148 locks the mandrel and sleeve in a position where the lower latch bowl 135 is ineffective to move the latching lugs inwardly and thus maintains the wellhead connector in the non-engaging position in a positive manner while it is being run. A control sleeve means indicated generally at 151 is reciprocal on the upper latch sleeve 126 to control the setting and release of the slip means and the releasable locking means. Referring first to the first to the system 149, a slip bowl carrier is provided by a tubular extension 152 on the upper end of the upper latch sleeve 126. This extension 152 has a plurality of vertically extending slots 153 and at its upper end a plurality of circumferentially arranged windows 154 which support segmented ring segments 155, which have inner surfaces 156 which are upwardly and inwardly inclined to provide a slip bowl.

The segmented segments 155 cooperate with slips 157 which have downwardly facing teeth and engage the upper mandrel 122 to lock the upper mandrel and upper latch sleeve 126 in a position to lock the wellhead connector to the tubing hanger.

The slips 157 are carried by the milled spring 158 by engaging an inwardly projecting flange 158A on the mill spring 158. The mill spring is secured at its upper end to the control sleeve 159 by the pin 161.

The milled spring 158 has a counterbore 158B at its upper end into which the ring segments 155 may expand when the control sleeve 159 is moved downwardly to move the counterbore 158B behind the segmented rings 155 to release the slips 157. With the system such that the slips 157 are engaged by the segmented ring 155 the milled spring 158 is in tension urging the slips upwardly against the segmented ring 155.

Shoulder 152A on extension 152 can engage a confronting shoulder 157A on slips 157 to positively disengage the slips from the mandrel if necessary.

At its lower end, the control sleeve 151 is provided with a detent flange 162 which detents the sleeve in its upper or lower position by moving over the resilient detent ring 163.

The releasable locking means 148 locks the wellhead connector in a relationship where the lower latch bowl 135 is ineffective to move the latch lugs inwardly. An external groove 164 cooperates with locking lugs 165 to releasably lock the upper mandrel 122 to the upper latch sleeve 126.

The locking lugs 165 are carried in windows 166 in the upper latch sleeve 126. The tubular extension 152 has a downwardly facing shoulder 152A and the control sleeve 151 has an upwardly facing shoulder 167 confronting the shoulder 152A. For convenience, this shoulder 167 as well as the detent flange 162 are carried on a threaded extension 159A of sleeve 159.

A milled spring 168 is held between the confronting shoulders 152A and 167. Surrounding the milled spring and also extending between the two shoulders is a spacer sleeve 169.

The milled spring 168 urges the lock lugs 165 inwardly into the groove 164 and when the lugs reside in groove 164 the milled spring expands and a groove 168A in the lower end of milled spring 168 overlies the lugs 165 to lock them in the groove 164 and secure the wellhead connector in the unlatched position.

The spacer 169 contains the spring 168 and limits upward movement of the control sleeve 159 relative to the upper latch sleeve 126.

Centralizing plastic bearings 171, 172, and 173 are provided to exclude trash.

Vertical access is provided through the wellhead connector tube 174 and another tube (not shown) which is carried in the upper end of the lower mandrel 121. Grooves 175 and 176 are provided in the bore through the tube 174 for receiving locking dogs. For a purpose which will appear hereinafter the upper surfaces 177 and 178 of the grooves are inclined downwardly and outwardly to provide cam surfaces. Below the grooves a smooth bore 179 is provided. Between the smooth bore and grooves, an upwardly facing no-go shoulder 181 is provided.

The tube 174 provides a landing nipple for receiving a wellhead plug to plug the tube during normal production.

The wellhead plug includes lower housing 182 and upper housing 183 secured together by the threaded connection 184. The lower housing carries the orientation pawl 185 urged by spring 186 into the vertical slot 187 in the lower mandrel 121 to orient the plug so that the inclined face 188 on the lower end of housing 182 is aligned with and forms a part of the passageway 142 to divert TFL tools which may pass through the flow line of the wellhead connector.

The plug is provided with downwardly facing shoulder means 189 whlich confronts the no-go shoulder 181. A metal seal ring 191 seals between the no-go shoulder and the confronting downwardly facing shoulder. A metal filler ring 192 of generally triangular shape is positioned immediately below the seal ring 191 and provides a shoulder for the V-packing 193 which seals with the smooth bore 179. The two metal rings and the V-packing are positioned prior to assembly of the upper and lower body sections of the plug and after the threaded connection 184 is made up, the locking pin 194 together with the threaded connection 184, lock the upper and lower sections of the plug body in the desired relationship.

Above the downwardly facing shoulder 189 the upper body 183 has a plurality of windows 195 in which lugs 196 are carried. These lugs have a pair of external lands providing upwardly facing shoulders 197 and 198 which are complimentary to and engage the cam surfaces 177 and 178 in tube 174.

The lugs 196 are expanded by a downwardly facing cone 199 carried on stem 201. A wrench means provided by a crossbar 202 is provided at the upper end of the stem 201 and rotation of the stem by means of the crossbar moves the expander cone 199 downwardly by make-up of the thread system 184 in a blind bore 204 in the body 183 and on the lower end of the stem. Prior to make-up the cone may be held in an elevated non-engaging position by the shear pin 203.

Desirably the plug may be removed by a vertical pull and for this purpose release means for the cone is provided. The cone is a part of a sleeve 206 which carries dogs 207 for cooperation with groove 205. Props 208 pinned to the sleeve 206 by shear pins 209 hold the dogs in groove 205. The props 208 are collet-like fingers on the lower end of the release sleeve 211. The sleeve 211 has an internal groove 212 providing shoulder 213 which may be engaged by a pulling tool to raise the release sleeve 211, shearing pin 209 to remove the props 208 from around the dogs 207. When this occurs the dogs 207 may move outwardly releasing the expander cones from the stem thus releasing lugs 196 from the landing nipple tube 174 and releasing the plug for removal. Confronting shoulders 200 and 220 may be engaged by a pulling force if needed to release lugs 196.

FIG. 9A shows the previously described landing nipple and tubing hanger with the hold-down rings expanded.

In FIG. 9B, an alternate form of this invention is illustrated. The no-go shoulder of the landing nipple indicated generally at 57A is provided by an arcuate surface 85A which cooperates with a mating arcuate surface on the metal seal indicated generally at 61B. The hold-down shoulder 93A is also arcuate and cooperates with the arcuate surface 96A on the upper hold-down ring 94A. The radius lines 214, 215 and radius lines 216, and 217 of FIG. 9A illustrate that the no-go shoulder and the hold-down shoulder in both forms are struck about the single center 91. Thus, in FIG. 9B the no-go shoulder 85A and the hold-down shoulder 93A are segments of spheres of different diameter. The remainder of FIG. 9B is identical to FIGS. 5B and 9A.

In operation the wellhead of FIG. 3 is conventionally completed to include the landing nipple 57 in the innermost casing. If the template of FIG. 1 is to be used several wellhead connectors are carried on their dummy posts and the wells are drilled and completed through the windows in the template.

The tubing hanger 59 or 59A is run into the well and landed on the no-go shoulder 85 or 85A as the case may be, to support the tubing hanger. A setting tool engages the sleeve 111 and a downward force shears pin 105. Further downward force drives the expander cones 104 under the rings 94 and 95 until the expander cones and hold-down rings reach the positions shown in FIGS. 9A or 9B. At this time the slips 107 lock the expanders in the expanded position and hold the hold-down rings firmly in engagement with the hold-down shoulders. As there is clearance between the tubing hanger and its supporting landing nipple, a lateral force on the tubing hanger may induce movement of the tubing hanger about the point 91 with such movement being permitted by the arcuate or substantially arcuate no-go supporting surface and hold-down surface in the landing nipple in cooperation with the complimentary surfaces on the metal seal and hold-down ring.

When it is desired to remove the tubing hanger, a pulling tool engages in groove 112 and an upward force shears the shear wire 113 permitting upward movement to bring the groove 114 into overlying relationship with the expander cone segments 109 to permit their expansion and release of slips 107. Further upward force returns the expander cone 104 to the position shown in FIG. 5B to release the hold-down rings 94 and 95 and permit removal of the tubing hanger.

After the tubing hanger has been landed and locked in place, the wellhead connector is lifted from its dummy post and set down on the tubing hanger until the surface 139 in the lower mandrel of the wellhead connector is supported on the upper end of the tubing hanger. At this time the seal ring 218 forms a metal seal between the upper end of the tubing head and the lower end of the lower mandrel 121 of the wellhead connector. This seal permits testing of the stab seal during landing procedures and is a back-up seal for the stab seals.

While positioning the wellhead connector on the tubing hanger, the parts will be in their position shown in FIG. 8 with the dogs 165 locking the latch lugs 136 and latch bowl 135 in their non-engaging position with the latch lugs 136 expandable into the groove 219 in the lower latch sleeve 125.

With the wellhead connector supported on the tubing hanger, a suitable running tool (not shown) secured to groove 210 in the control sleeve 151 moves the control sleeve upwardly. During this movement the detent flange 162 passes over detent 163 and the control sleeve shoulder 167 engages the mill spring 168 placing it in compression and moving it from over the locking lugs 165 permitting these lugs to expand out of the groove 164 as shown in FIG. 7A. The shoulder 167 on the control sleeve engages the spacer sleeve 169 and further upward movement of the control sleeve transmits force through the shoulder 152A to the carrier 152 and thence to the upper latch sleeve 126. This sleeve may now move upwardly as the locking lugs 165 have been released. In such movement, force is transmitted to the lower latch sleeve 125 and the slip bowl 135 raised to engage and move the latch lugs 136 radially inwardly where they engage and lock into the grooves 76 and 77 (FIG. 5A) on the tubing hanger thus locking the wellhead connector to the tubing hanger.

As the control sleeve 151 is pulled upwardly, the milled spring 158 is placed in tension pulling the slips 157 upwardly under the segmented ring 155. As the upper end of the milled spring is secured to the control sleeve by pin 161, it has moved upwardly to the position shown in FIG. 7A. In this position, the cone provided by the ring segments 155 are moved out of the counterbore 158B and are held in their inward or retracted position by the upper internal surface of the milled spring 158 as shown in FIG. 7A. The ring segments urge the slips 157 into engagement with the upper mandrel 122 and latch the mandrel and the latch sleeve to each other in a position locking the wellhead connector to the tubing hanger as shown in FIGS. 3, 7A and 7B.

The well plug would have been previously made up and positioned in the tube 174 as shown in FIG. 7A.

If it is desired to provide for vertical entry into the well, the access cap 68 is removed and a pulling tool run into the tube 174. Upward force on the release sleeve 211 shears pins 209 permitting removal of the prop fingers 208 from over the dogs 207 permitting them to expand out of groove 205. As the props 208 come into engagement with the surface 200 on the sleeve 206, they exert an upward force on the expander 199 to release the plug which now may be removed.

At the surface the well plug may be redressed and rerun with the stem 201 held in its upper position by the shear pin 205. A rotary jar (not shown) imparts rotational movement to the stem 201 through the wrench pin 202 to shear the pin 205 and drive the stem downwardly through the action of the thread system 203 to where the lugs 196 are expanded into engagement with the dog body and the upper cam surfaces on lugs 196 force the plug downwardly to compress the metallic seal 191 and hold this seal in compressed condition to provide a metallic seal in cooperation with the resilient seal provided by the V-packing 179.

When it is desired to remove the wellhead connector, a pulling tool engages the upper end of the control sleeve 151 and downward force is exerted to drive this sleeve downwardly until the detent flange 162 moves over the detent 163. When this occurs, the lugs 155 may move into the counterbore 158B on the milled spring to release the slips 157. With these slips released, further downward force on the control sleeve is transmitted through the lower end of the control sleeve to the flange 129 to move the latch sleeve downwardly relative to the mandrel and disengage the latch bowl 135 from the latch lugs 136 thus releasing the wellhead connector from the tubing hanger. As the upper latch sleeve 126 moves downwardly, the locking lugs 165 will drop into grooves 164 and the mill spring 168 will extend such that its lower section overlies the locking lug to lock the wellhead connector in the disengaged position as shown in FIG. 8. At this time the wellhead connector may be picked up and set over on its associated dummy post.

The previous description is illustrative of embodiments of the present invention. Changes and modifications will be readily apparent to those skilled in the art and may be made without departing from the scope of the invention which is defined in the claims.

The embodiments of the invention in which an exclusive property or privilege is claimed are defined as follows:

1. An apparatus comprising:

landng nipple means providing passageway means therethrough;

upwardly facing no-go shoulder means in said passageway means;

locking groove means in said passageway means above said no-go shoulder means;

said locking groove means including downwardly facing cam shoulder means; and plug means in said passageway means comprising:

plug housing means;

downwardly facing shoulder means on said housing means confronting said no-go shoulder means;

metal seal means on sad plug housing means between said no-go shoulder means and said downwardly facing shoulder means;

bore means in said plug housing means having threads adjacent the lower end of said bore means;

lug means carried by said plug housing means;

said lug means having upwardly facing surfaces complementary to and engaging said cam shoulder means;

stem means having a threaded nose in threaded engagement with said bore means threads;

downwardly facing expander cone means on said stem means for expanding said lug means;

said cone means in engagement with said lug means and holding said lug means upwardly facing surfaces in engagement with said downwardly facing cam shoulder means to compress said seal means; and wrench means on the upper end of said stem means for threading said stem means into said bore means to expand said lug means and compress said seal means between said no-go shoulder means and said housing shoulder means to seal therebetween.

2. The apparatus of claim 1, wherein resilient seal means is provided on said plug housing means for sealing engagement with said landing nipple means.

3. The apparatus of claims 1 or 2, wherein:

said expander cone means is slidably carried for longitudinal movement by said stem means;

dog means carried by said expander cone means cooperate with a groove in said stem means to latch and release said cone means and stem means; and prop means is secured to said cone means by shear means to releasably maintain said dog means in said stem means groove.

4. The apparatus of claim s 1 or 2 in combination with a wellhead connector having a diverter housing with a vertical passageway therein and wherein said landing nipple means provides a part of said vertical passageway, and the lower end of said plug means is inclined relative to the longitudinal axis of the vertical passageway to provide a diverter surface.

5. The apparaus of claim 3 in combination with a wellhead connector having a diverter housing with a vertical passageway therein and wherein said landing nipple means provides a part of said vertical passageway, and the lower end of said plug means is inclined relative to the longitudinal axis of the vertical passageway to provide a diverter surface.

* * * * *